US005984207A

United States Patent [19]

Wang

[11] Patent Number: 5,984,207

[45] Date of Patent: Nov. 16, 1999

[54] CONTROL VALVE SEAT OF WATER NOZZLE

[76] Inventor: Hsin-Fa Wang, 68 Mou Dan Lane, Jaw An Lee, Lou Kang Township, Chan Hua Hsien, Taiwan

[21] Appl. No.: 09/099,029

[22] Filed: Jun. 17, 1998

[51] Int. Cl.[6] ..... B05B 9/01

[52] U.S. Cl. ..... 239/526; 239/586

[58] Field of Search ..... 239/525, 526, 239/583, 586

[56] References Cited

U.S. PATENT DOCUMENTS

| | | | |
|---|---|---|---|
| 2,416,719 | 3/1947 | Stockdale | 239/526 X |
| 3,361,300 | 1/1968 | Kaplan | 239/526 X |
| 4,396,156 | 8/1983 | Southworth et al. | 239/526 |
| 4,483,483 | 11/1984 | Grime | 239/526 |
| 4,909,443 | 3/1990 | Takagi | 239/526 X |
| 5,630,548 | 5/1997 | Chih | 239/526 X |
| 5,791,564 | 8/1998 | Carra | 239/583 X |

*Primary Examiner*—Andres Kashnikow
*Assistant Examiner*—Steven J. Ganey
*Attorney, Agent, or Firm*—Harrison & Egbert

[57] ABSTRACT

A pistol-type water nozzle has a body provided with an actuating member and a control valve seat capable of being actuated by the actuating member. The control valve seat is composed of a valve seat tube, a valve tube member, a slide rod, a press rod member, and a tension spring. The valve seat tube is provided with a plurality of locating cavities. The valve tube member is provided with a plurality of protuberances. The valve tube member is fitted into the valve seat tube such that the protuberances of the valve tube member are retained in the locating cavities of the valve seat tube. The slide rod is slidably received in an axial hole of the valve tube member. The press rod member is provided with an action block and is received in the axial hole of the slide rod. The tension spring is fitted into the valve tube member such that the slide rod is urged by one end of the tension spring, and that the tubular handle of the body is urged by another end of the tension spring.

1 Claim, 7 Drawing Sheets

CONTROL VALVE SEAT OF WATER NOZZLE

FIELD OF THE INVENTION

The present invention relates generally to a pistol-type nozzle, and more particularly to a control valve seat of the pistol-type nozzle.

BACKGROUND OF THE INVENTION

As shown in FIG. 1, a prior art water nozzle is provided with a barrel 1 in which a control valve member is located such that a threaded rod 2 is extended backward. A control lever 4 is fastened pivotally with a tubular body 3 such that the control lever 4 is engaged at the top end thereof with the threaded rod 2 by means of a nut 5. In operation, the control lever 4 and the tubular body 3 are held in the palm. As the control lever 4 is pressed by the palm, the threaded rod 2 is actuated to trigger the control valve member which is located in the barrel 1. Such a water nozzle of the prior art as described above is defective in design in that it can not be comfortably operated with the palm of a hand.

SUMMARY OF THE INVENTION

The primary objective of the present invention is to provide a pistol-type water nozzle free from the drawbacks of the pistol-type water nozzle of the prior art.

In keeping with the principle of the present invention, the foregoing objective of the present invention is attained by an improved pistol nozzle having a control valve seat which is composed of a valve seat tube, a valve tube member, a slide rod, a press rod member, and a tension spring. The pistol nozzle of the present invention is simplified in construction such that the pistol nozzle can be easily operated by a hand.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
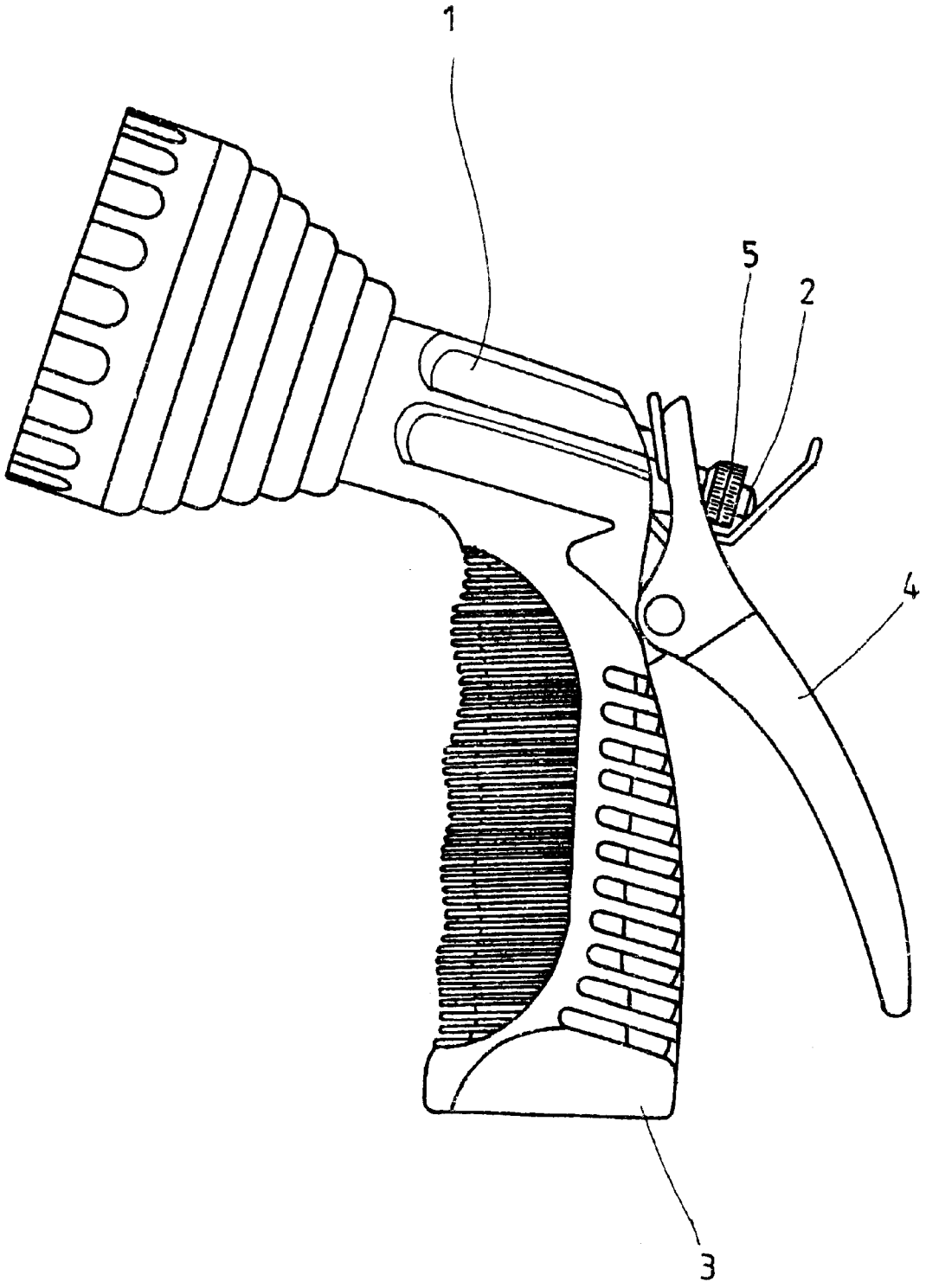
FIG.1 PRIOR ART
FIG. 1 shows a slide view of a pistol-type nozzle of the prior art.
Figure 2:
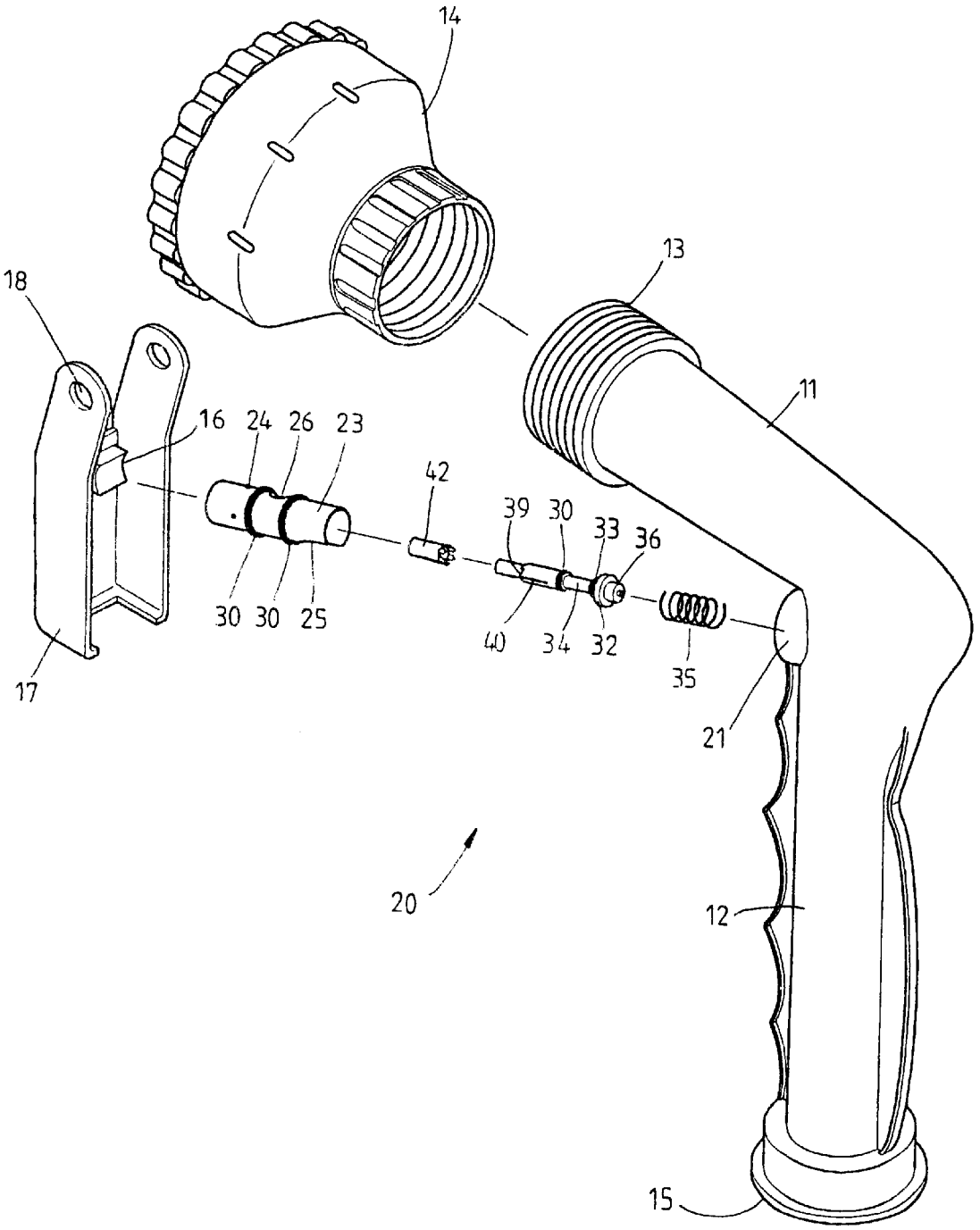
FIG. 2 shows an exploded view of a pistol-type water nozzle of the present invention.
Figure 3:
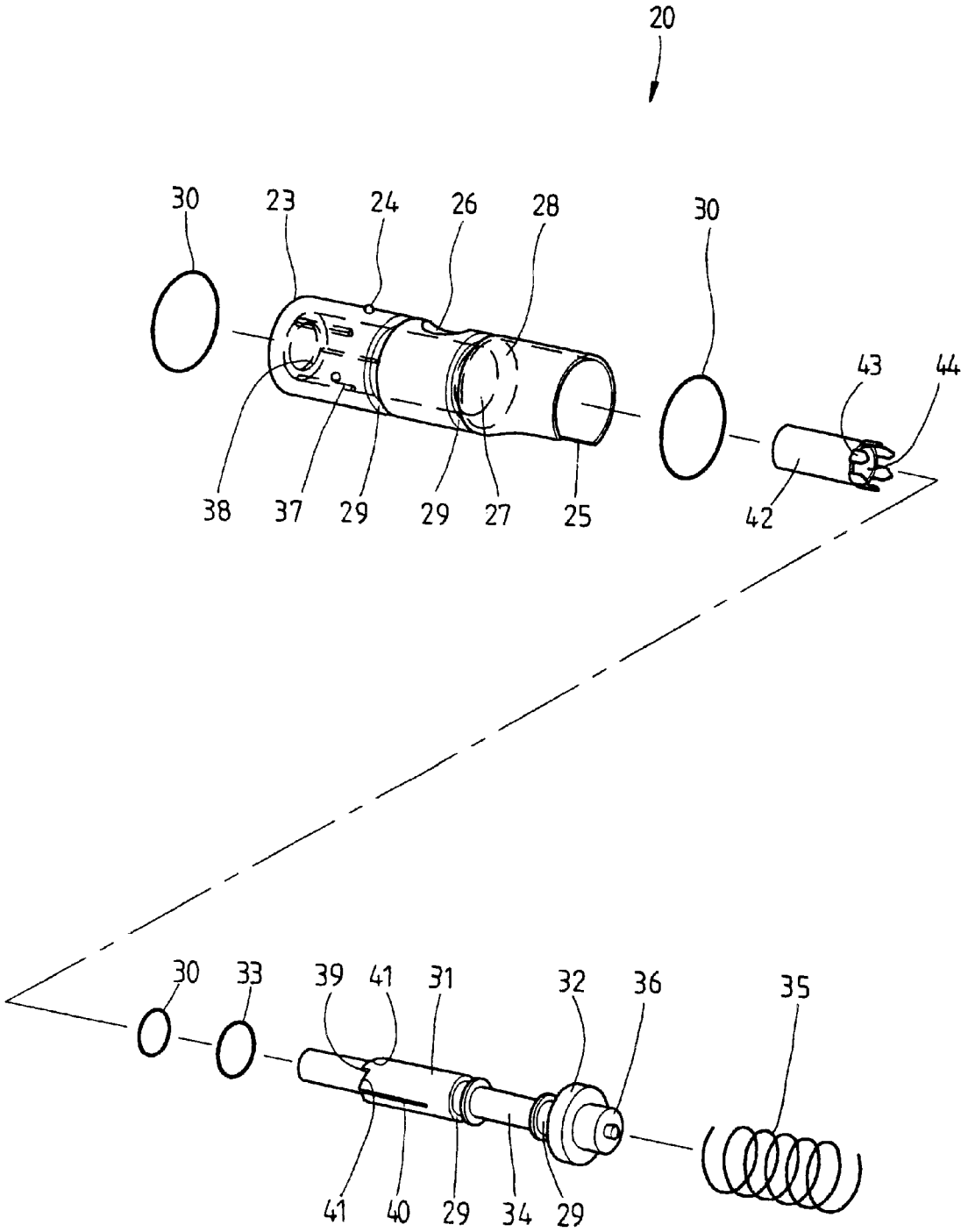
FIG. 3 shows an exploded view of the control valve seat of the pistol nozzle of the present invention.

As shown in FIGS. 2 and 3, a pistol-type water nozzle embodied in the present invention has a body 10, which is composed of a barrel 11 and a tubular handle 12 in communication with the barrel 11. The barrel 11 is provided at the front end thereof with a threaded portion 13 engageable with a spray head 14, whereas the tubular handle 12 is provided at the rear end thereof with an inner threaded section 15 engageable with a hose. The tubular handle 12 is provided in the upper section thereof with a control valve seat 20 capable of being actuated by an actuating member 17 having an urging portion 16 of an arcuate construction. The actuating member 17 is provided in the upper end thereof with two pivoting holes 18 by which the actuating member 17 is fastened pivotally with a shaft 19 of the body 10.

As shown in FIGS. 2–5, the control valve seat 20 includes a valve seat tube 21, a valve tube member 23, a slide rod 31, a press rod member 42, and a tension spring 35.

The valve seat tube 21 is extended integrally from the upper section of the tubular handle 12 such that the valve seat tube 21 is located in proximity to the junction of the barrel 11 and the tubular handle 12, and that the hollow interior of the valve seat tube 21 is in communication with the hollow interiors of the barrel 11 and the tubular handle 12. The valve seat tube 21 is provided in the inner wall of the outer end thereof with two locating cavities 22 symmetrical with each other.

The valve tube member 23 is of a cylindrical construction and is fitted into the valve seat tube 21. The valve tube member 23 is provided in the outer wall thereof with two protuberances 24 which are engaged with the two locating cavities 22 of the valve seat tube 21. The valve tube member 23 is further provided in the inner end thereof with an opening 26 and an indentation 25 which is separated from the opening 26 by a distance. The valve tube member 23 has a slide axial hole 27 having a circular stepped edge 28, a plurality of ribs 37 and a position confining edge 38. The valve tube member 23 is provided in the periphery thereof with two circular grooves 29 for locating two leakproof rings 30.

The slide rod 31 is received in the valve tube member 23 such that the slide rod 31 is located in the slide axial hole 27. The slide rod 31 is provided in the front section thereof with a position confining slot edge 39 and a rib slot 40, which are provided respectively with an inclined guide edge 41. The slide rod 31 is provided in the tail end thereof with a stop ring edge 32 and is further provided in the midsection thereof with a recess 34 having two circular grooves 29*a* adjacent each end of the recess 34 for locating two leakproof rings 33*a* and 33*b*.

The press rod member 42 is received in the valve tube member 23 and is provided with a plurality of action blocks 43 having a protruded portion 44 corresponding in location to the inclined guide portion 41 of the slide rod 31.

The tension spring 35 is fitted into the rear section of the valve tube member 23 such that the front end of the tension spring 35 urges the stop ring edge 32 of the slide rod 31, and that the rear end of the tension spring 35 urges the wall of the tubular handle 12.

Figure 4:
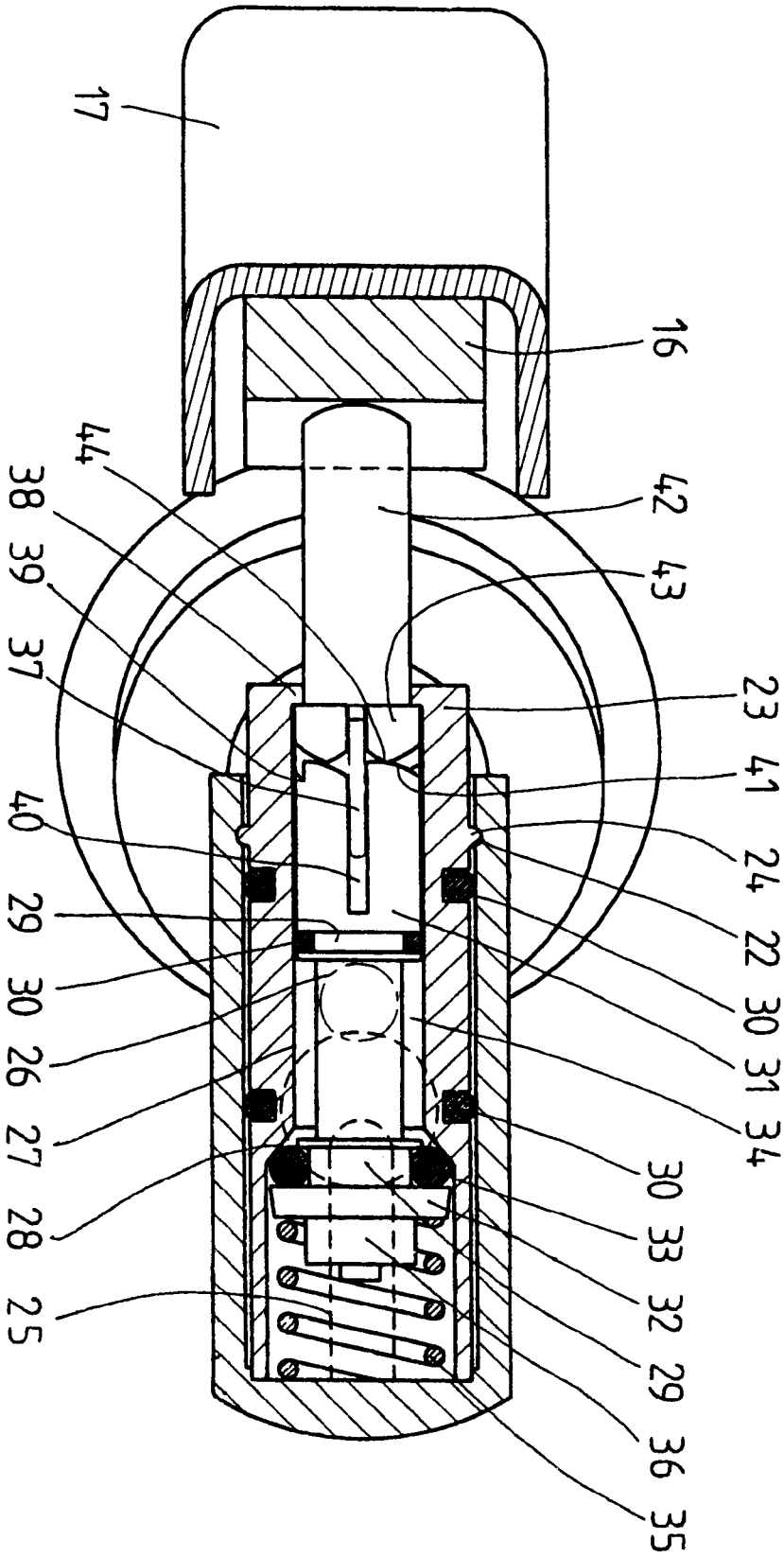
FIG. 4 shows a cross sectional view of the water nozzle of the present invention in combination.
Figure 5:
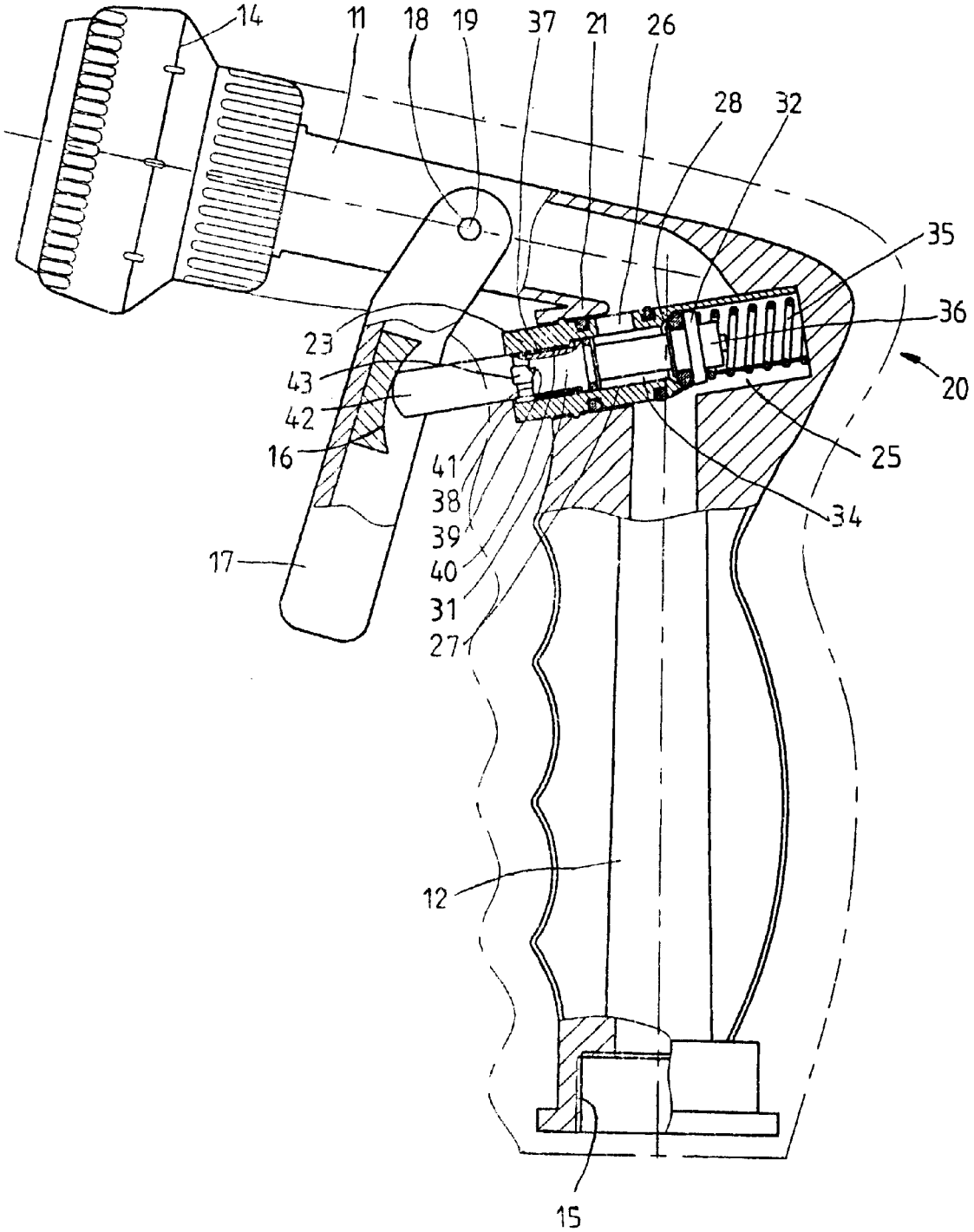
FIG. 5 shows a longitudinal sectional view of the water nozzle of the present invention in combination.
Figure 6:
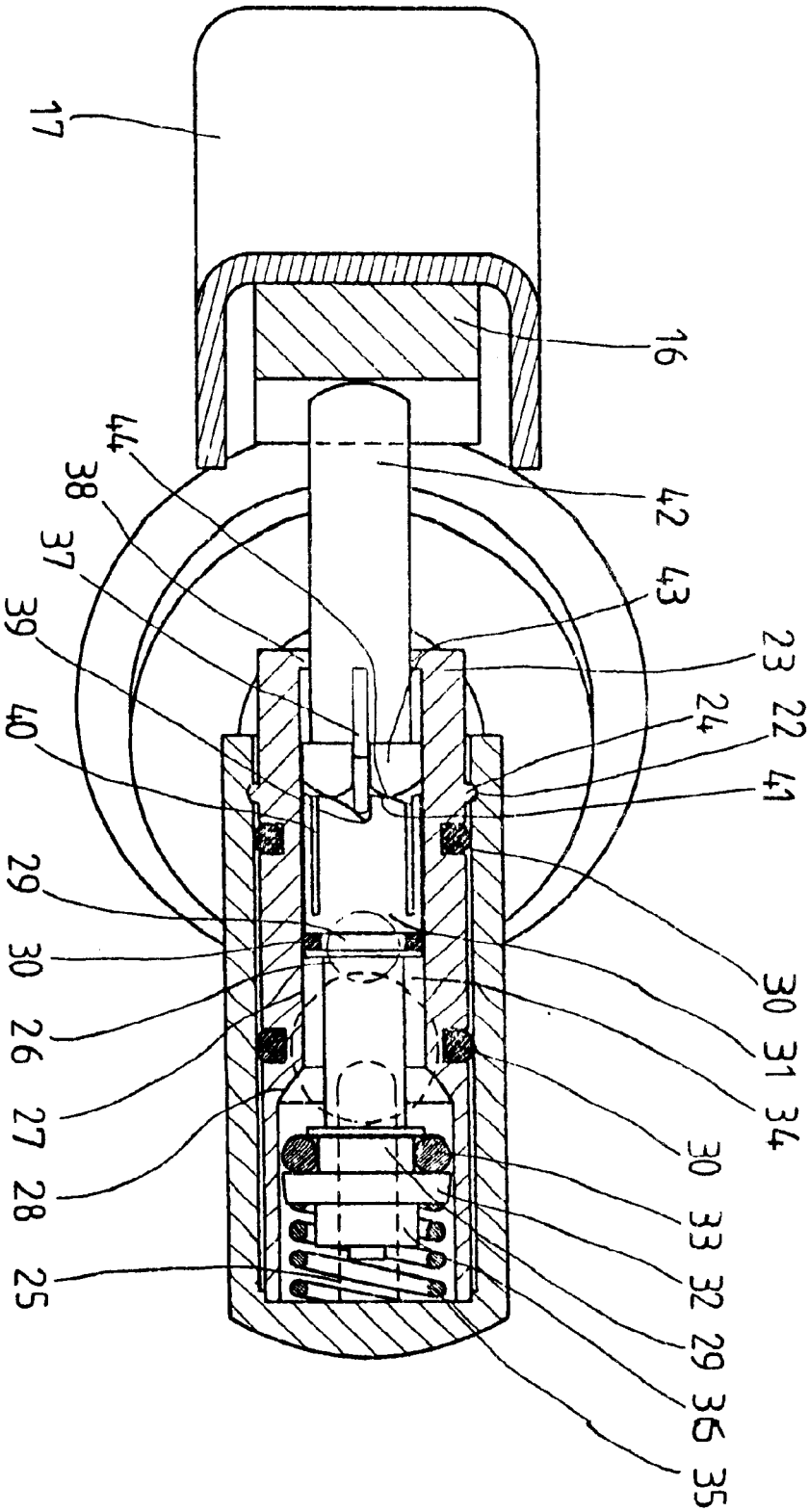
FIG. 6 shows a cross sectional schematic view of the water nozzle of the present invention in operation.
Figure 7:
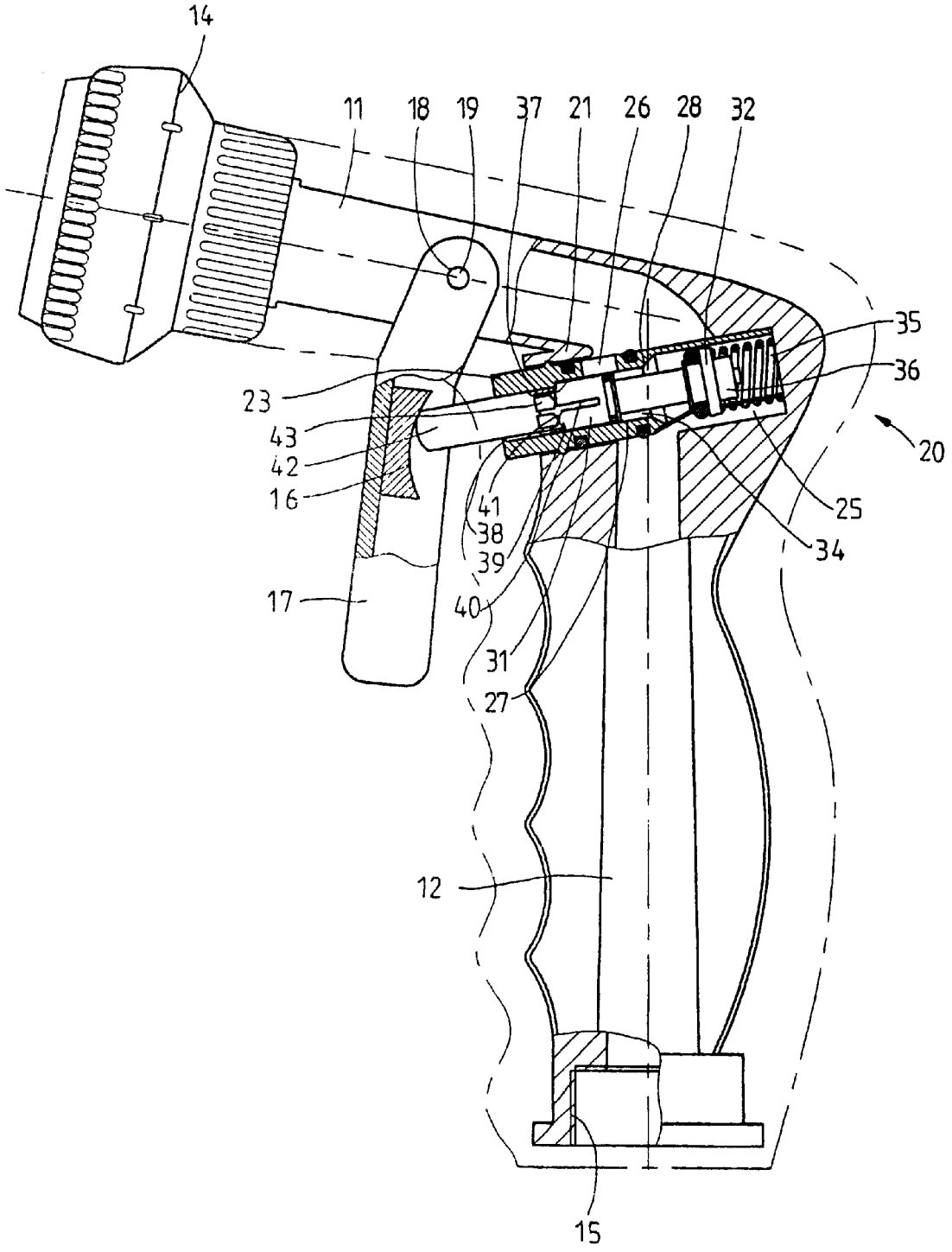
FIG. 7 shows a longitudinal sectional schematic view of the water nozzle of the present invention in operation.

The valve tube member 23 is fitted into the valve seat tube 21 such that the protuberances 24 of the valve tube member 23 are retained securely in the locating cavities 22 of the valve seat tube 21. Before the valve tube member 23 is fitted into the valve seat tube 21, the press rod member 42, the slide rod 31 and the tension spring 35 are arranged in the valve tube member 23 such that the press rod member 42 is extended outside via the slide axial hole 27, and that the protruded portion 44 of the action block 42 of the press rod member 42 urges the inclined guide edge 41 of the slide rod 31. As shown in FIGS. 6 and 7, the position confining slot edge 39 of the slide rod 31 is urged by the rib 37 so as to enable the stop ring edge 32 and the leakproof ring 33*b* to disengage the circular stepped edge 28 of the valve tube member 23. As a result, the opening 26 is in communication with the indentation 25. When the rib slot 40 of the slide rod 31 is engaged with the rib 37, the stop ring edge 32 and the leakproof ring 33*b* of the slide rod 31 are urged by the tension ring 35 to engage intimately with the circular stepped edge 28. As a result, the indentation 25 and the opening 26 are not in communication with each other, as shown in FIGS. 4 and 5. The control valve seat 20 can be easily actuated by the actuation member 17. The tension spring 35 provides the slide rod 31 with a force enabling the slide rod 31 to displace forward. The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

I claim:

1. A pistol-type nozzle having a body composed of a barrel and a tubular handle in communication with said barrel, said barrel provided at a front end thereof with a threaded portion engageable with a spray head, said tubular handle provided at a rear end thereof with an inner threaded portion engageable with a water hose, said tubular handle further provided in an upper section thereof with a control valve seat capable of being actuated by an actuating member having an urging portion of an arcuate construction, said actuating member provided in an upper end thereof with two pivoting holes by which said actuating member is fastened pivotally with a shaft of said body;

wherein said control valve seat comprises:

a valve seat tube extending from an upper section of said tubular handle such that said valve seat tube is located in proximity of a junction of said barrel and said tubular handle, and that a hollow interior of said valve seat tube is in communication with hollow interiors of said barrel and said tubular handle, said valve seat tube provided in an inner wall of an outer end thereof with two locating cavities;

a cylindrical valve tube member provided in an outer wall thereof with two protuberances and fitted into said valve seat tube such that said two protuberances are retained in said two locating cavities of said valve seat tube, said valve tube member further provided in an inner end thereof with an opening and an indentation, said valve tube member having a slide axial hole provided with a circular stepped edge, a plurality of ribs and a position confining edge, said valve tube member still further provided in a periphery thereof with two circular grooves for locating two leakproof rings;

a slide rod received in said valve tube member such that said slide rod is located in said slide axial hole, said slide rod provided in a front section thereof with a position confining slot edge and a rib slot, said rib slot provided with an inclined guide edge, said slide rod provided in one end thereof with a stop ring edge and in a midsection thereof with a recess;

a press rod member received in said valve tube member and provided with a plurality of action blocks having a protruded portion corresponding in location to said inclined guide portion of said slide rod; and a tension spring fitted into said valve tube member such that a front end of said tension spring urges said stop ring edge of said slide rod, and that a rear end of said tension spring urges said tubular handle.

* * * * *